US010894585B1

(12) United States Patent
Benedict et al.

(10) Patent No.: US 10,894,585 B1
(45) Date of Patent: Jan. 19, 2021

(54) SLIDING SEAT TOP AND NOVEL HULL SHAPE FOR FISHING KAYAK

(71) Applicant: BIG ADVENTURES, LLC, Fletcher, NC (US)

(72) Inventors: Shane Benedict, Fletcher, NC (US); Bryon Phillips, Fletcher, NC (US)

(73) Assignee: Big Adventures, LLC, Fletcher, NC (US)

( * ) Notice: Subject to any disclaimer, the term of this patent is extended or adjusted under 35 U.S.C. 154(b) by 313 days.

(21) Appl. No.: 15/901,083

(22) Filed: Feb. 21, 2018

Related U.S. Application Data

(60) Provisional application No. 62/530,928, filed on Jul. 11, 2017.

(51) Int. Cl.

| | |
|---|---|
| ***B63B 34/20*** | (2020.01) |
| ***B63B 1/04*** | (2006.01) |
| ***B63H 16/20*** | (2006.01) |
| ***B63B 1/06*** | (2006.01) |
| ***B63B 1/08*** | (2006.01) |
| ***B63B 34/21*** | (2020.01) |
| ***B63B 34/26*** | (2020.01) |
| ***B63B 29/04*** | (2006.01) |

(52) U.S. Cl.
CPC ..... *B63B 34/20* (2020.02); *B63B 1/04* (2013.01); *B63B 1/042* (2013.01); *B63B 1/06* (2013.01); *B63B 1/08* (2013.01); *B63B 34/21* (2020.02); *B63H 16/20* (2013.01); *B63B 34/26* (2020.02); *B63B 2029/043* (2013.01); *B63H 2016/202* (2013.01)

(58) Field of Classification Search
CPC ..... B63B 34/20; B63B 34/21; B63B 34/26; B63B 2029/043; B63B 1/04; B63B 1/042; B63B 1/06; B63B 1/08; B63H 16/12; B63H 16/20; B63H 2016/202
USPC ..... D12/302
See application file for complete search history.

(56) References Cited

U.S. PATENT DOCUMENTS

| | | | | |
|---|---|---|---|---|
| 4,795,381 | A * | 1/1989 | Willems | B63H 16/14 440/26 |
| D399,814 | S * | 10/1998 | Toro | D12/306 |
| 6,210,242 | B1 * | 4/2001 | Howard | B63B 1/042 440/21 |
| 6,718,905 | B1 | 4/2004 | Peerson et al. | 114/347 |
| 6,923,139 | B1 | 8/2005 | Robichaux et al. | 114/347 |
| D544,824 | S | 6/2007 | Eckert | D12/302 |
| 7,320,291 | B2 | 1/2008 | Eckert | 114/347 |

(Continued)

*Primary Examiner* — Ajay Vasudeva
(74) *Attorney, Agent, or Firm* — MacCord Mason PLLC

(57) ABSTRACT

A watercraft suitable for fishing has a rotomolded deck and hull. The deck includes a cockpit with substantially vertical sidewalls, a rear wall, a pedaling installation, and a flat floor between the sidewalls extending from the rear wall to the pedaling installation in the cockpit. The hull includes a depression between lateral protrusions amidships and a stern with a rounded cross section so that the combination of the lateral protrusions and rounded stern cross section allow the watercraft to track straight on water and for the stern to move laterally when the watercraft is turned on a body of water. The watercraft may also include a seat movably mounted onto spaced apart grooves installed on the flat floor of the cockpit that extend from a rear position near the rear wall to a forward position near the pedaling installation.

16 Claims, 8 Drawing Sheets

(56) References Cited

U.S. PATENT DOCUMENTS

| | | | | |
|---|---|---|---|---|
| 7,461,612 | B1 * | 12/2008 | Houck | B63B 34/20 114/347 |
| 8,590,478 | B2 | 11/2013 | Lipman | 114/363 |
| 10,059,410 | B2 * | 8/2018 | Boyer | B63B 35/14 |
| 10,220,924 | B1 * | 3/2019 | Horvath | B63B 5/24 |
| 2002/0158178 | A1 | 10/2002 | Garelick et al. | 248/420 |
| 2008/0060569 | A1 * | 3/2008 | Howard | B63H 25/10 114/347 |

* cited by examiner

SLIDING SEAT TOP AND NOVEL HULL SHAPE FOR FISHING KAYAK

CROSS-REFERENCE TO RELATED APPLICATIONS

This application claims the benefit of U.S. Provisional Patent Application No. 62/530,928 filed Jul. 11, 2017, entitled SLIDING SEAT TOP AND NOVEL HULL SHAPE FOR FISHING KAYAK.

BACKGROUND OF THE INVENTION

People use personal watercraft such as kayaks and canoes for recreational activities including fishing, bird-watching, sightseeing, and the like. A traditional kayak or canoe, however, must be manually propelled using a paddle or oars. When a person is fishing in a kayak or canoe, handling a paddle or oars can prevent a person from simultaneously handling a fishing rod or other fishing gear. Similarly, when a person is bird-watching or sightseeing in a kayak or canoe, handling paddles or oars can prevent a person from simultaneously handling binoculars, maps, guidebooks, and the like. In addition, even when a paddle or oars are not being used by a paddler, having a paddle or oars onboard can sometimes interfere with the person's non-paddling activities.

Watercraft with pedal-operated propulsion devices installed overcome issues arising from having to handle a paddle or oars. A pedal propulsion device enables a person to operate the watercraft with his/her feet while having one or both hands free. Pedal propulsion devices also offer a recreational alternative to traditional paddling methods.

However, pedal-propelled devices in traditional kayaks may still interfere with activities where standing is desired, such as angling. The seat is typically installed adjacent to the pedal propulsion device, and therefore prevents a user from comfortably standing within the cockpit. Moreover, standing in the cockpit may increase the susceptibility of the watercraft to tip or roll over.

Accordingly, there still remains a need for a watercraft that can accommodate a standing user while still retaining the option for the user to sit and propel the watercraft with pedals.

SUMMARY OF THE INVENTION

The present invention fulfills one or more of these needs in the art by providing an improved watercraft having a deck and hull rotomolded as a combination, with the hull including a depression between lateral protrusions amidships. The stern of the hull has a rounded cross section so that the combination of the lateral protrusions and rounded stern cross-section allows the watercraft to track straight on water and for the stern to move laterally when the watercraft is turned on a body of water.

In a preferred embodiment, the lateral protrusions of the hull extend from an edge of the depression toward the bow. In one embodiment, the depression on the hull is generally in the shape of an oval. The depression overlaps substantially along the cockpit and a ridge extends from a forward edge of the oval toward the bow. A fin may be included at an opposing edge of the oval toward the stern. A pair of shallow recesses may be placed toward the stern of the hull to form a rounded convex surface.

The deck includes a cockpit having substantially vertical sidewalls, a rear wall, a pedaling installation, and a flat floor between the sidewalls extending from the rear wall to the pedaling installation in the cockpit. Scuppers may be installed along the flat floor of the deck to carry water overboard from the deck.

Rearward of the pedaling installation, the deck is quite flat and has two grooves that enable the selective positioning of a seat forward or aft along the deck. The seat can be positioned for comfortable pedaling of the pedaling installation to a desired selected fishing spot. The seat can then be moved to the stern, leaving a long, flat area between the pedaling installation and the seat for the user to stand on for fishing. In addition to the long fore-and-aft dimension, the watercraft has an overall width that provides a stable platform for the fisherman. An anti-slip material may be added onto the flat floor of the deck to provide traction and prevent the user from slipping while standing in the cockpit. Alternatively, the flat floor may be molded to have an anti-slip texture.

In a preferred embodiment, the flat floor of the cockpit has spaced apart grooves extending from a rear position near the rear wall to a forward position near the pedaling installation. A seat is movably mounted in the grooves. The grooves may be over twice as long as the seat length to provide ample space within the interior of the cockpit. In other embodiments, the grooves may not be that long. The seat may be positioned along the grooves to at least partially abut the rear wall. The seat may also include a storage compartment under the seat, which moves with the seat as the seat is moved in the grooves.

In one embodiment, each spaced apart groove comprises a continuous channel that extends from the rear of the watercraft to the front of the watercraft. These channels are adapted to receive a slider that mounts the seat to the groove, so that the seat can be adjusted by sliding the slider along the continuous channel of the groove. The seat may further include a stop for securing the seat onto a position along the groove.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
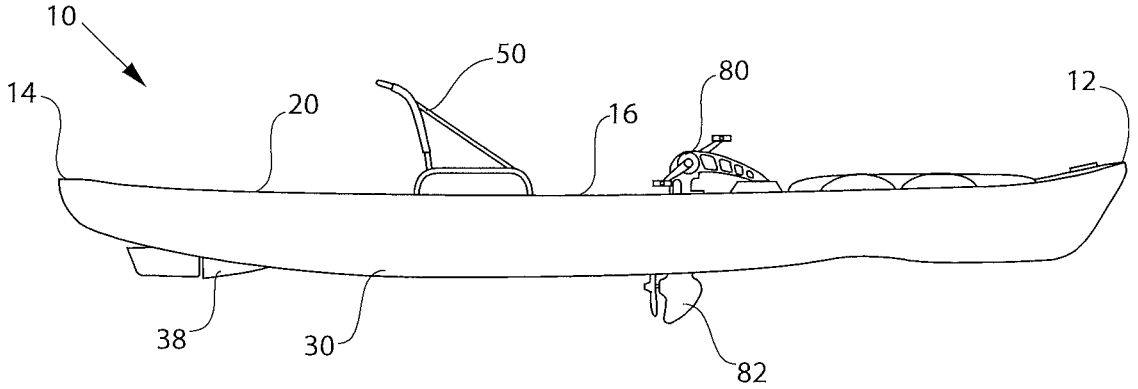
FIG. 1 is a side elevational view of a watercraft constructed according to one embodiment.

FIG. 1 shows a watercraft 10 made in accordance with the features of the current invention. The watercraft 10 has a bow 12 and a stern 14 with an intermediate cockpit 16. The cockpit 16 is the recessed part of the kayak where the user may either stand or sit. A deck 20 and hull 30 are rotomolded as a unitary combination to form the watercraft 10. Rotomolded kayaks and sit-on-top kayaks are well known, but not in a configuration in accordance with the invention. Rotomolded sit-on-top kayaks usually have hulls and decks that form a unitary combination with air between them, assuring buoyancy.

Figure 2:
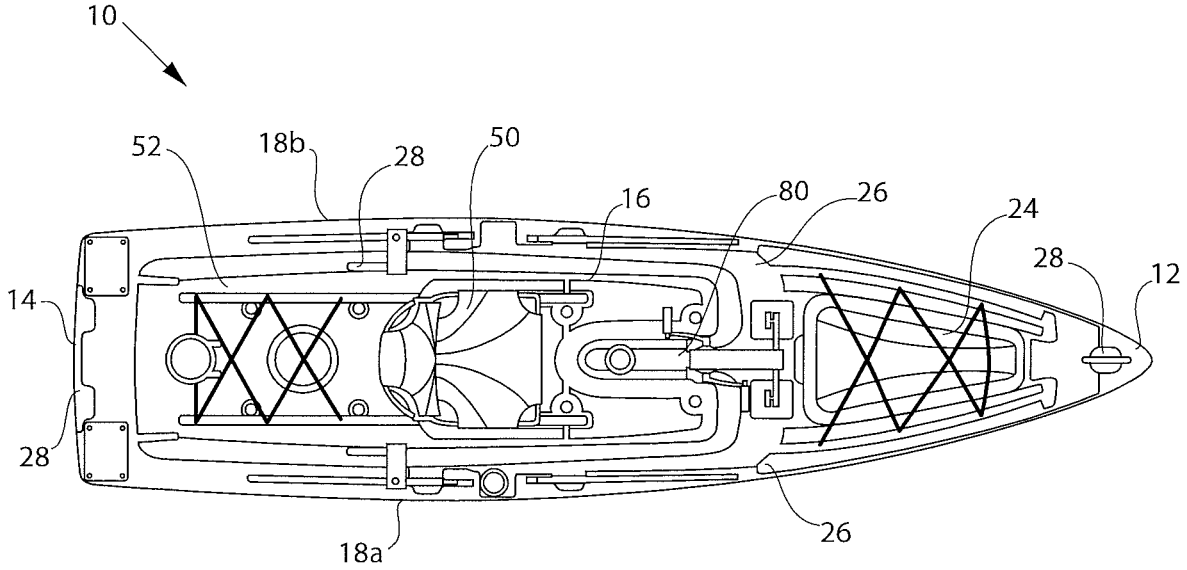
FIG. 2 is a top plan view of the embodiment shown in FIG. 1.

As seen in FIG. 2, the cockpit 16 includes a seat 50 and a pedaling assembly 80 for propelling the watercraft 10. The seat 50 is installed onto a pair of spaced apart grooves that enable the seat's position to be adjusted fore-and-aft along the watercraft. Positioning the seat 50 toward the pedaling assembly 80 enables the user to propel the watercraft 10. If the user wants to stand, the user can stand adjacent the pedaling assembly 80 or behind the seat 50. In addition, moving the seat 50 toward the stern 14 enables the user to having a large standing space between the seat and the pedaling assembly for activities such as fishing. In the embodiment shown, the watercraft is about 13.5 feet long and the overall width of the cockpit 16 is about 42 inches (measured between the outsides of sidewall 18*a* and sidewall 18*b*). Such a large width provides a stable platform for the user to stand while fishing. Other embodiments may have other lengths, such as 12 feet or 10 feet.

FIG. 2 shows additional features of a preferred watercraft 10. A storage compartment 24 may be included in the bow 12. The storage compartment 24 may include a storage hatch installed within a cavity of the hull 30. The bow 12 may also include elongated fishing rod holders 26 installed horizontally along the sidewalls of the bow 12. Grab handles 28 may also be included on the cockpit 16, bow 12, and/or stern 14 to assist a user in sliding the watercraft in or out of the water.

Figure 3:
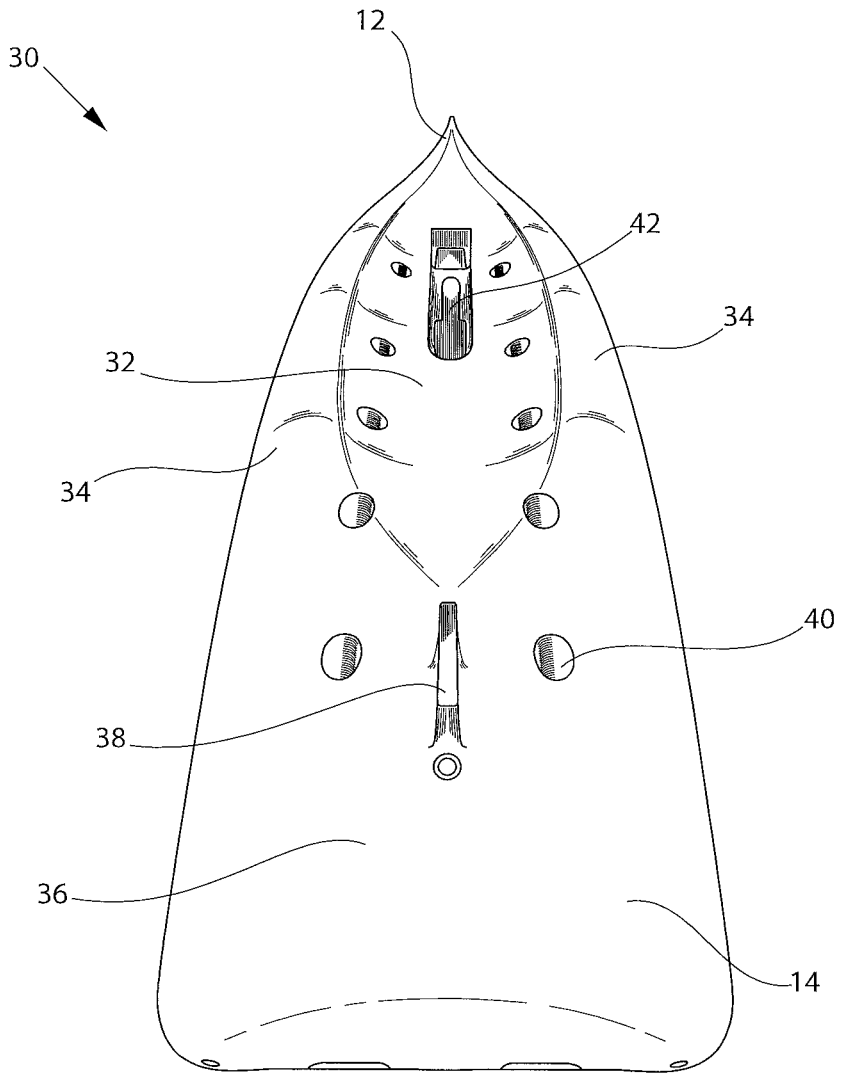
FIG. 3 is a bottom perspective view of a rotomolded hull facing the stern.
Figure 4:
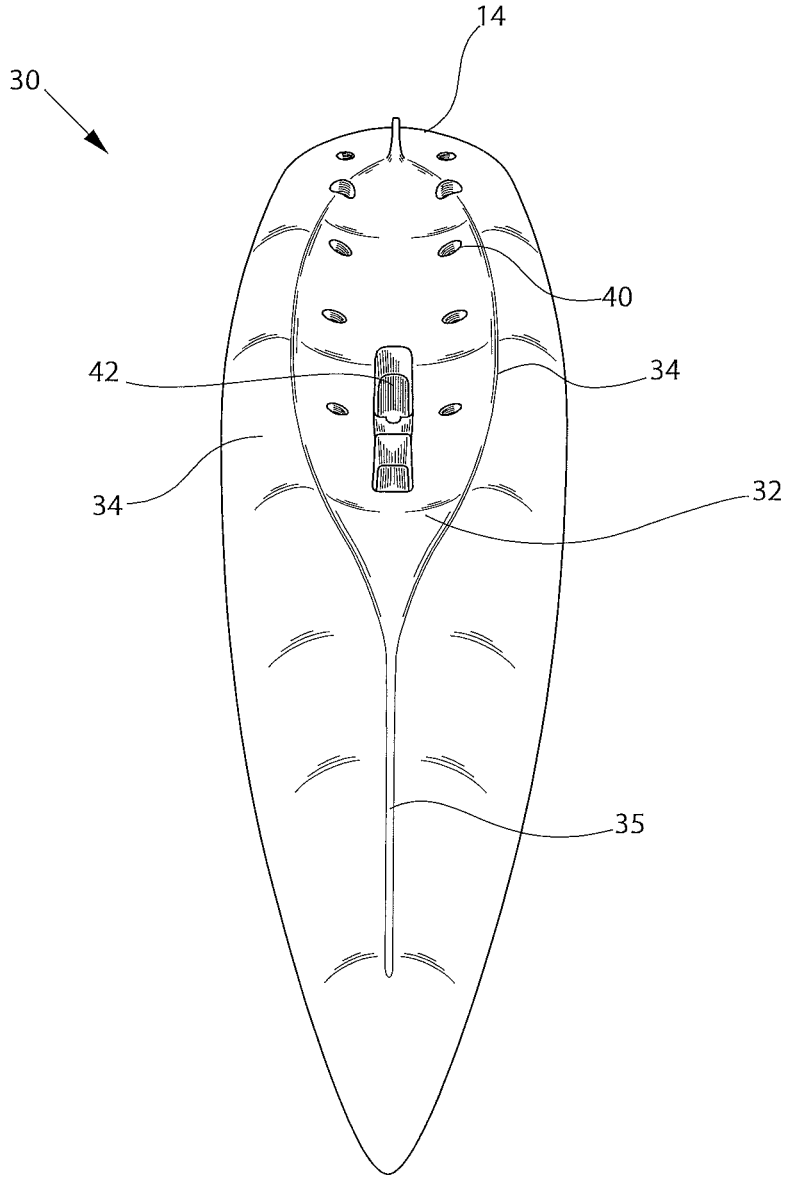
FIG. 4 is a bottom perspective view of the hull of FIG. 3 facing the bow.

Various features of the hull 30 or bottom of the watercraft can be seen in FIGS. 3-6. The hull 30 has a plain, rounded stern, with tracking features further forward on the watercraft. These tracking features and rounded stern cooperate so that when a turn of direction of the watercraft is desired, the front of the boat stays in position with the rear swinging sideways. As shown in FIGS. 3 and 4, the hull 30 includes a depression 32 between lateral protrusions 34. Depression 32 and lateral protrusions 34 are positioned amidships. The depression 32 may be positioned to substantially overlap along a portion of the cockpit. In the embodiment shown, the depression 32 is substantially oval-shaped, with the lateral protrusions 34 forming the lateral edges along the depression's major axis of symmetry. Scuppers or holes 40 are included in the hull to drain water from the deck.

A slot 42 in the depression 32 allows the pedaling assembly 80 (which can be motorized) to extend through the watercraft from the cockpit and into the water. The pedaling assembly can be a Propel pedaling assembly available from Legacy Paddlesports LLC of Fletcher, N.C. Such assemblies are described in US Patent Publication 2009/0042461 to Walton. Other suitable pedaling assemblies be used, such as a pedal drive available from Old Town Canoe that can be seen at https://www.youtube.com/watch?v=7H1AxgqRuUs; or a pedal drive from Confluence Watersports which can be seen at http://www.yakangler.com/kayaks-and-gear/item/3817-confluence-outdoor-new-kayaks-and-more-icast-2016; or a pedal drive from FeelFree that can be seen at https://www.rapidmedia.com/kayakangler/categories/gear/7842-feelfree-just-released-a-new-motor-pedal-drive-system.html; or pedal drives from Hobie and Crazy Kayak.

FIG. 4 shows a ridge 35 formed from the lateral protrusions 34 and extending from a forward edge of the depression 52 toward the bow. The ridge 35 provides directional control to the watercraft 10 to help keep the craft going straight when that is desired. This is called "tracking" in the art. The depression 32 and accompanied lateral protrusions 34 also help with the tracking and maintain the watercraft's balance when a user is standing in the cockpit 16. A fin 38 may also be included to provide tracking. As seen in FIG. 3, the fin 38 is positioned along the same axis as the ridge 35 toward the stern.

Figure 5:
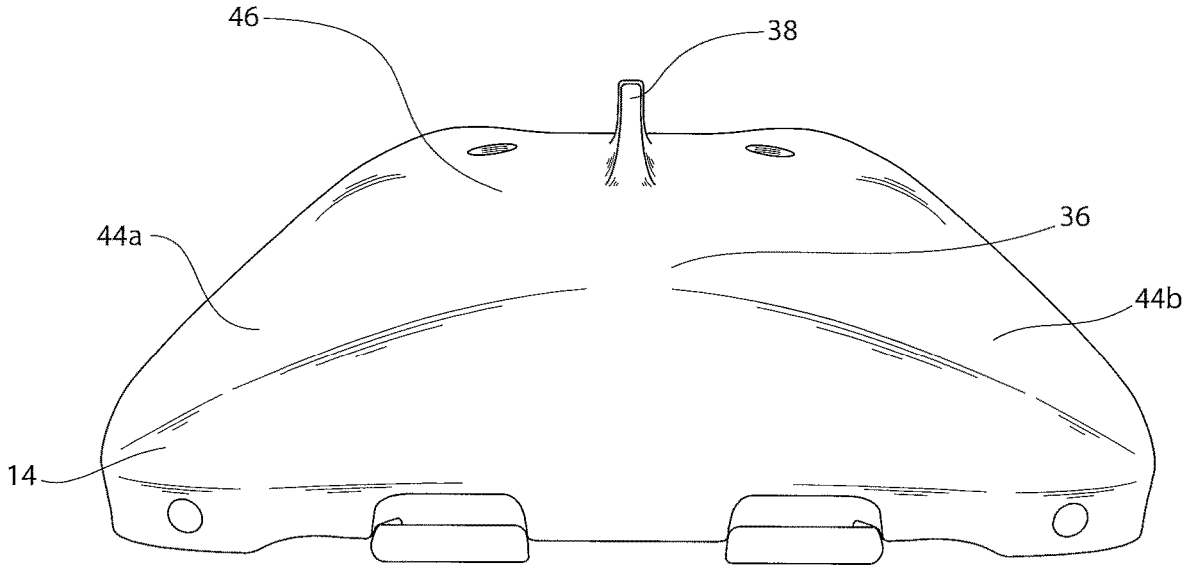
FIG. 5 is an enlarged rear perspective view of the stern of the hull of FIG. 3.
Figure 6:
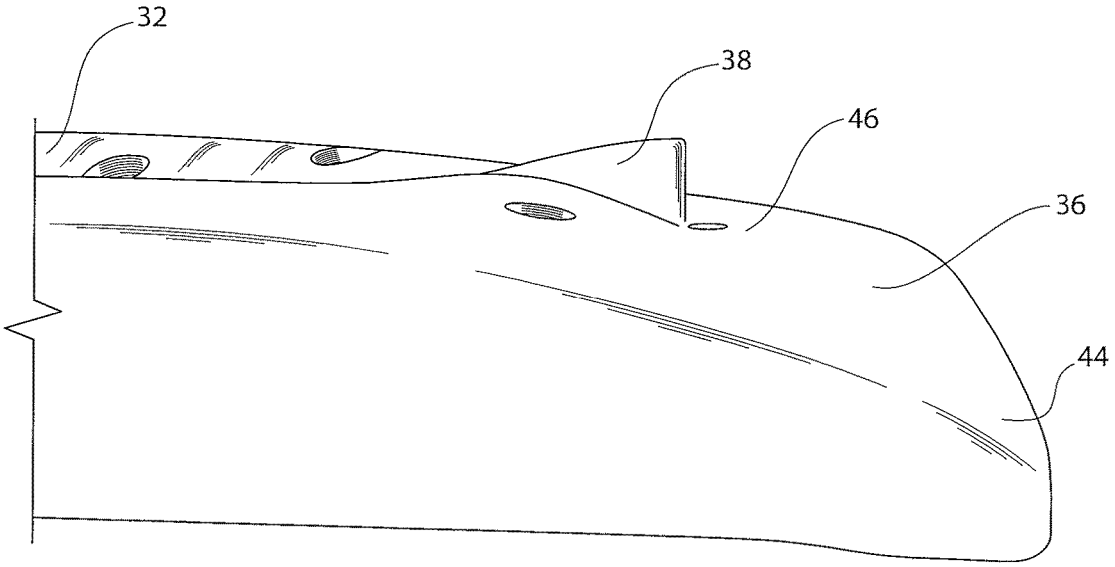
FIG. 6 is an enlarged side perspective view of the hull of FIG. 3.

The stern 14 of the hull 30 is shaped with a rounded cross-section. The rounded cross section allows the stern 14 to move laterally as the watercraft turns on a body of water. The turning may be initiated by a rudder (not shown). This lateral movement of the stern is unlike conventional kayaks in which turns of the craft occur by shifting a forward part of the craft to the side, with the stern following. The result is an unusually short turning radius. As seen in FIGS. 5 and 6, the rounded cross section is comprised of a convex surface 36 with a pair of shallow recesses 44*a, b* along its side near the corners of the stern 14. An additional recess 46 may be included between the convex surface 36 and the fin 38. The shallow recesses 44*a* and 44*b* further help maintain the watercraft's stability and allow the rear of the craft to shift sideways in a turn.

Figure 7:
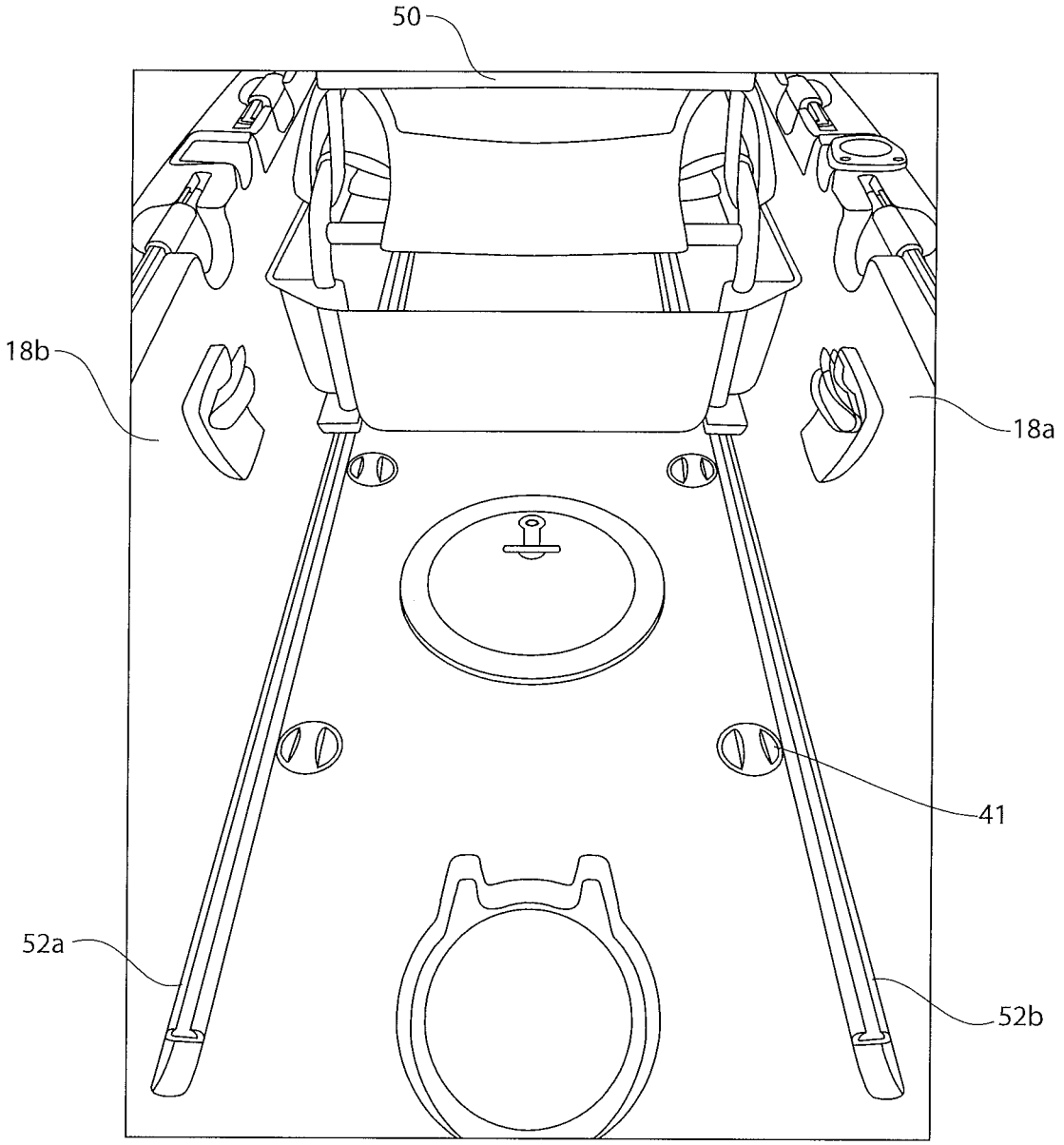
FIG. 7 is an enlarged perspective view of the cockpit from the rear with the seat positioned away from the pedaling assembly.
Figure 8:
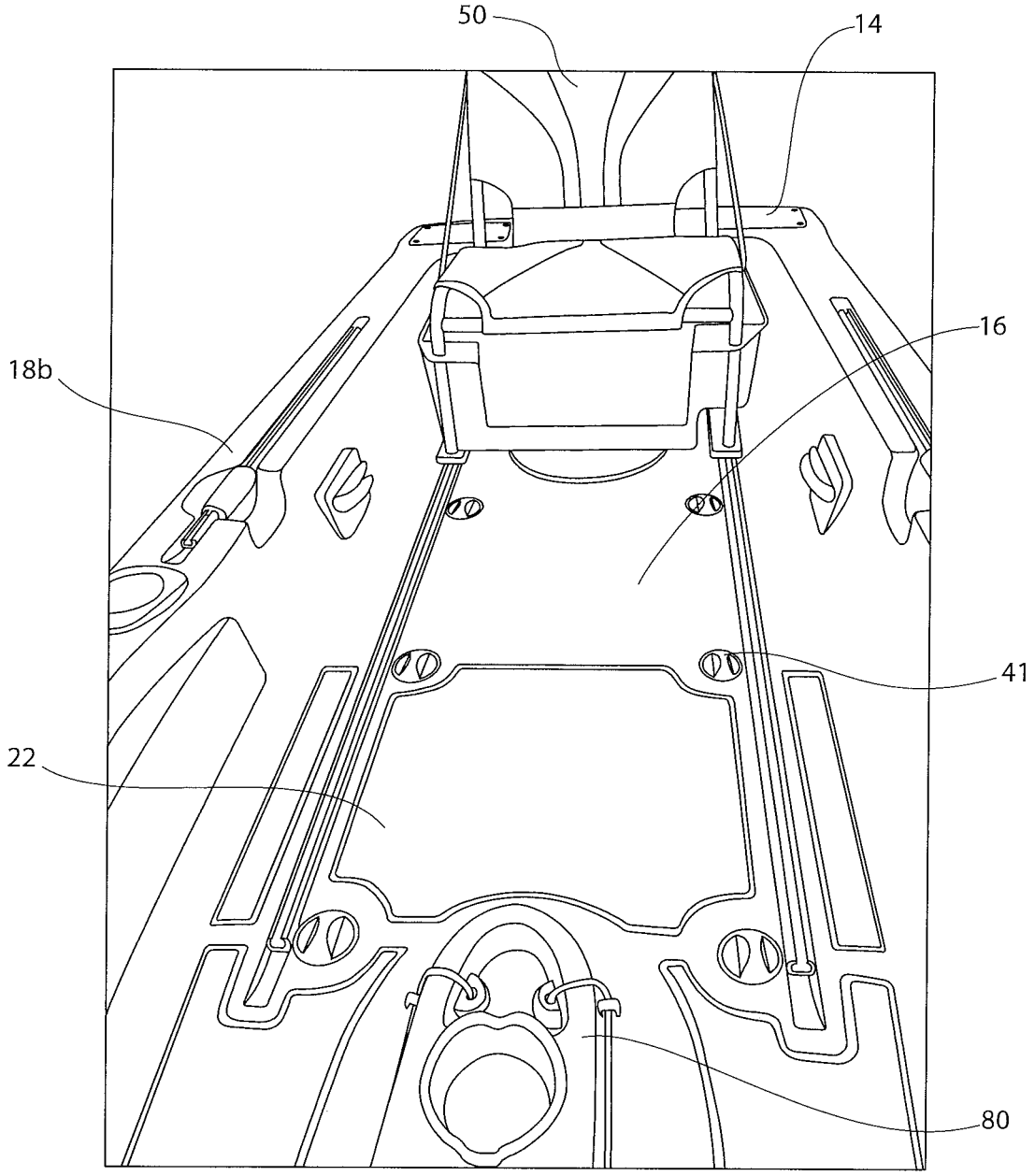
FIG. 8 is an enlarged perspective view of the cockpit from the front with anti-skid material installed onto the floor and the seat abutting the rear wall of the watercraft.

FIG. 7 shows the inside of the cockpit 16 including a pair of grooves 52*a* and 52*b* spaced apart and positioned parallel to sidewalls 18*a* and 18*b*. The grooves may extend to a length that is over twice as long as the length of seat 50. Scuppers 41 can also be positioned between the deck 20 and hull 30 to enable cockpit water to drain through holes 40. As seen FIG. 8, anti-slip surfaces 22 may be added onto the floor of the cockpit to provide traction and reduce the likelihood that the user will slip while standing. Alternatively, the floor of the cockpit can be molded with an anti-slip texture.

Figure 9:
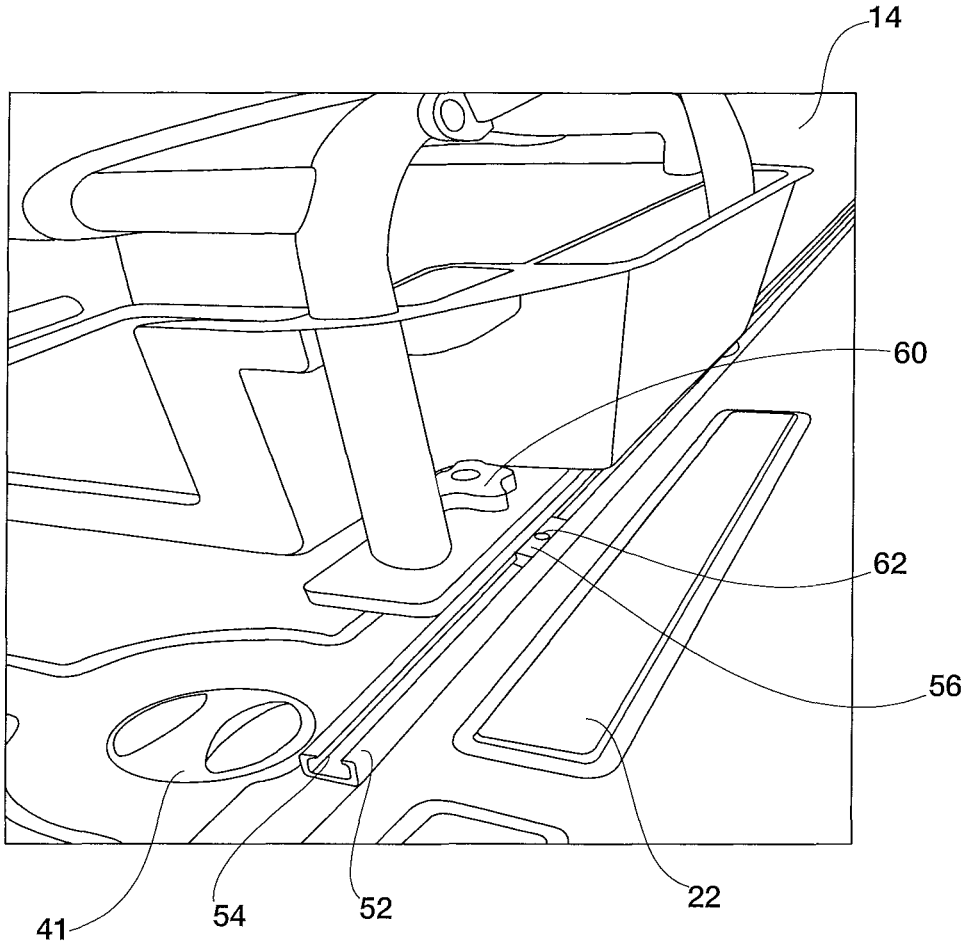
FIG. 9 is an enlarged perspective view of the seat unmounted from a groove installed on the cockpit's floor.
Figure 10:
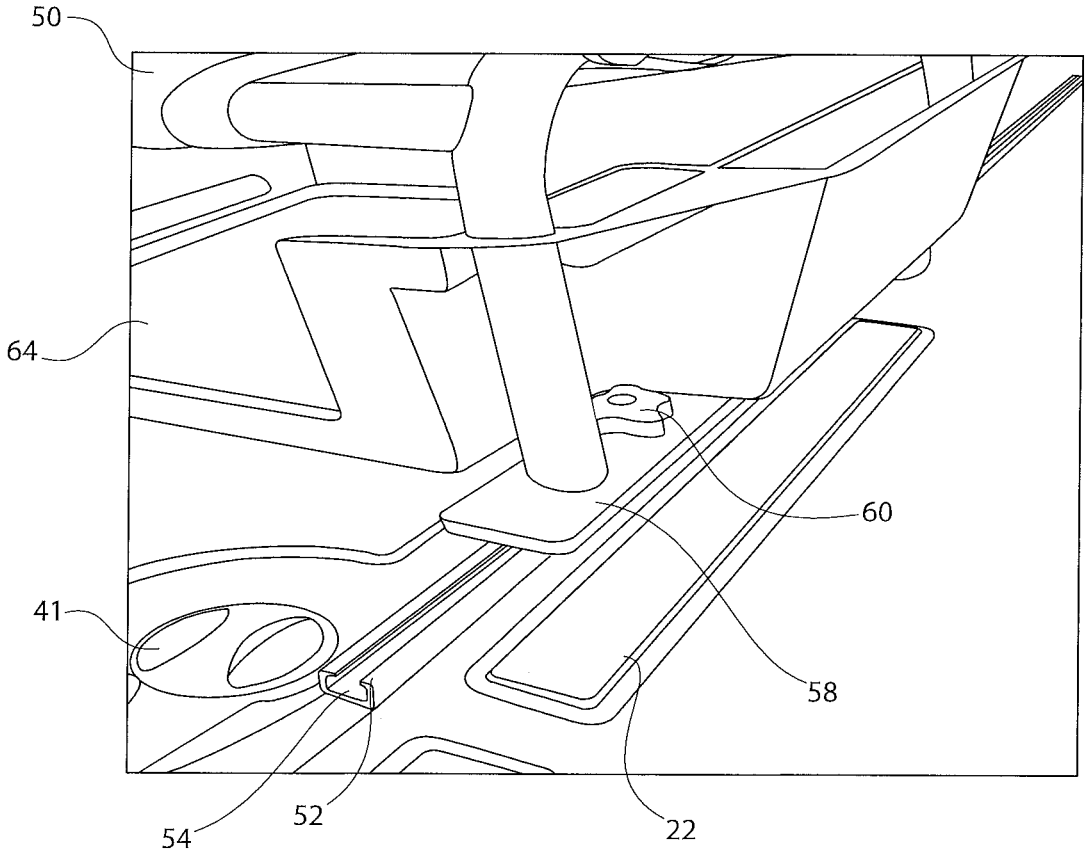
FIG. 10 is an enlarged perspective of the seat mounted onto the groove.

FIGS. 9 and 10 show details of one embodiment wherein the seat is movably mounted along pair of grooves 52 by sliding along a linear slide rail system. Each groove 52 comprises a continuous channel 54 that acts as a linear guide for the seat 50 to move. A stop holds the seat in a desired position along the channels. In one embodiment of a stop a slider 56 is located within the continuous channel 54 and is adapted to slide along the length of the continuous channel 54. The slider 56 includes a threaded recess 62 adapted for receiving a fastener for mounting. The seat 50 includes a fastener with an adjustment knob 60 for mounting the seat 50 onto the slider 56 by means of a threaded shaft that is positioned within recess 62. Turning the knob in one direction tightens the knob against the top of the groove 52 to hold the seat position. Loosening the knob allows seat re-positioning. Once the knob is loosened, the seat 50 moves with slider 56 along the channel 54. The seat 50 may include a storage bin or compartment 64 at its underside, the bin or compartment moving with the seat as the seat is moved in the grooves 52.

The seat 50 may move from the front of the watercraft next to the pedaling assembly 80 to the rear of the watercraft abutting the rear wall of the stern 14. The rear wall may act as a stop to prevent the seat 50 from moving any further along groove 52. In addition, a stop may also be included to fix the seat 50 at a specific position along continuous channel 54.

The seat can be positioned near the pedaling assembly for comfortable pedaling. Once a fishing destination has been reached, the seat can be slid toward the stern, leaving a larger, stable standing area so the fisherman can stand while fishing. With the seat at its forward location, a second seat can be mounted to the cockpit to allow a second person to sit.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A kayak suitable for fishing comprising:

a deck and hull rotomolded as a combination with a bow and a stern, the deck having a cockpit including a pedaling installation and a seat, the hull having a shape that includes a. a bow that has a central ridge, b. the central ridge extending aft of the bow as two lateral protrusions on left and right sides of the hull with a depression between the lateral protrusions, the lateral protrusions and depression being amidships of the hull, c. the lateral protrusions each widening aft of the depression until they merge to become a single stern hull shape with a smooth, rounded cross-section, so that the combination of the lateral protrusions and single stern hull shape with a rounded cross-section allow the kayak to track straight on a body of water and for the stern to move laterally when the kayak is turned on a body of water.

2. The kayak as claimed in claim 1 wherein:

the cockpit has substantially vertical sidewalls, a rear wall, and a flat floor between the sidewalls extending from the rear wall to the pedaling installation in the cockpit.

3. The kayak as claimed in claim 2, wherein the flat floor of the cockpit has spaced apart grooves extending from a rear position near the rear wall to a forward position near the pedaling installation, and a seat movably mounted in the grooves.

4. The kayak as claimed in claim 3, wherein the seat has a seat length and the grooves are over twice as long as the seat length.

5. The kayak as claimed in claim 4, wherein the seat may be positioned to at least partially abut the rear wall.

6. The kayak as claimed in claim 3, wherein the seat has a storage compartment under the seat, the storage compartment movable with the seat as the seat is moved in the grooves.

7. The kayak as claimed in claim 3, wherein each spaced apart groove comprises a continuous channel extending from the rear wall of the kayak toward the front of the kayak adapted to receive a slider mounting the seat to the groove so that the seat can be adjusted by sliding the slider along the continuous channel of the groove.

8. The kayak as claimed in claim 3, wherein the seat further includes a stop for securing the seat onto a position along the groove.

9. The kayak as claimed in claim 2 further including an anti-slip surface on the flat floor of the deck.

10. The kayak as claimed in claim 1 further including a plurality of scuppers in the cockpit of the deck and adapted to carry water downward from the deck.

11. The kayak as claimed in claim 1 wherein the lateral protrusions extend from lateral edges of the depression toward the bow.

12. The kayak as claimed in claim 1, wherein the depression on the hull is generally in the shape of an oval.

13. The kayak as claimed in claim 1, wherein the depression overlaps substantially along the cockpit and the central ridge extends from a forward edge of the oval toward the bow.

14. The kayak as claimed in claim 13 further including a fin at an opposing edge of the oval toward the stern.

15. The kayak as claimed in claim 1 further including a pair of shallow recesses forming a rounded convex surface at the stern of the hull.

16. A kayak suitable for fishing comprising:

a deck and hull rotomolded as a combination with a bow and a stern, the deck having a cockpit including a pedaling installation and a seat, the cockpit having substantially vertical sidewalls, a rear wall, and a flat floor between the sidewalls extending from the rear wall to the pedaling installation in the cockpit, the flat floor of the cockpit having spaced apart grooves extending from a rear position of the flat floor near the rear wall to a forward position near the pedaling installation, and the seat having a seat length and being movably mounted in the grooves, the grooves being over twice as long as the seat length, the hull having a shape that includes a. a bow that has a central ridge that extends aft of the bow to a forward edge of an oval-shaped depression toward the bow, b. the central ridge continuing as two lateral protrusions on left and right sides of the hull with the oval-shaped depression between the lateral protrusions and substantially overlapping the cockpit, the lateral protrusions and depression being amidships of the hull, c. a fin at a rear of the oval-shaped depression extending toward the stern, and d. the lateral protrusions each widening aft of the oval-shaped depression until they merge aft of the fin to become a single stern hull shape with a smooth, rounded cross-section, so that the combination of the lateral protrusions and single stern hull shape with a rounded cross-section allow the kayak to track straight on a body of water and for the stern to move laterally when the kayak is turned on a body of water.

* * * * *